US008109420B2

(12) United States Patent
Martinez

(10) Patent No.: US 8,109,420 B2
(45) Date of Patent: Feb. 7, 2012

(54) FLASHLIGHT DEPLOYMENT SYSTEM

(76) Inventor: Michael Anthony Martinez, Albuquerque, NM (US)

( * ) Notice: Subject to any disclaimer, the term of this patent is extended or adjusted under 35 U.S.C. 154(b) by 744 days.

(21) Appl. No.: 12/253,980

(22) Filed: Oct. 19, 2008

(65) Prior Publication Data

US 2009/0101684 A1 Apr. 23, 2009

Related U.S. Application Data

(60) Provisional application No. 60/981,201, filed on Oct. 19, 2007.

(51) Int. Cl.
*B65D 25/10* (2006.01)
*A45F 5/00* (2006.01)

(52) U.S. Cl. ..... 224/197; 224/242; 224/247; 224/268

(58) Field of Classification Search ..... 224/197, 224/242, 247, 674, 678, 914, 268, 269; 248/690
See application file for complete search history.

(56) References Cited

U.S. PATENT DOCUMENTS

| | | | | | |
|---|---|---|---|---|---|
| 1,318,850 | A * | 10/1919 | De Yong | 362/396 |
| 1,403,707 | A * | 1/1922 | Quarnstrom | 362/396 |
| 4,214,688 | A * | 7/1980 | Griffin, Jr. | 224/197 |
| 4,830,247 | A * | 5/1989 | Banks | 224/666 |
| 4,955,518 | A * | 9/1990 | Parsons et al. | 224/247 |
| 5,232,137 | A * | 8/1993 | Devine | 224/666 |
| 5,412,545 | A * | 5/1995 | Rising | 362/105 |
| 5,449,104 | A * | 9/1995 | Parsons et al. | 224/245 |
| 5,564,610 | A * | 10/1996 | Barron | 224/268 |
| 5,605,263 | A * | 2/1997 | Pursley et al. | 224/248 |
| 5,617,980 | A * | 4/1997 | Parsons et al. | 224/251 |
| 5,699,943 | A * | 12/1997 | Schaefer et al. | 224/197 |
| 5,772,089 | A * | 6/1998 | Parsons et al. | 224/251 |
| 5,850,954 | A * | 12/1998 | Dong-Joo | 224/197 |
| 6,045,017 | A * | 4/2000 | Connell | 224/148.7 |
| 6,435,469 | B1 * | 8/2002 | Ratcliff et al. | 248/535 |
| 6,497,349 | B1 * | 12/2002 | Ramirez | 224/245 |
| 6,557,739 | B1 * | 5/2003 | Pursley et al. | 224/268 |
| 6,702,165 | B1 * | 3/2004 | Ramirez | 224/199 |
| 6,817,499 | B2 * | 11/2004 | Martinez | 224/197 |
| 6,889,878 | B2 * | 5/2005 | Parsons | 224/200 |
| 7,185,796 | B2 * | 3/2007 | Parsons | 224/197 |
| 7,331,872 | B1 * | 2/2008 | Parsons | 463/47.2 |
| 2007/0278266 | A1 * | 12/2007 | Parsons | 224/197 |

* cited by examiner

*Primary Examiner* — Justin Larson
*Assistant Examiner* — Lester L Vanterpool
(74) *Attorney, Agent, or Firm* — Yorgos D. Marinakis

(57) ABSTRACT

A holder for a flashlight with a sheath that is variably positionable during use. A variably positionable sheath formed with a cavity and having an axial post. At least one u-shaped flexible removable grasping member is formed in the cavity. The u-shaped member has bent arms that apply pressure to the flashlight bell when it is inserted into the cavity. A disk with a plurality of pegs is rotatably mounted on the sheath, with o-rings that wrap both around pegs on the disk and around the pegs on the sheath or disk base, allowing the sheath to be rotated by the user and causing it to return automatically to its original position. A clip is engaged for securing the sheath to the user. A method for manufacturing a holder for a flashlight with a sheath that is variably positionable during use.

5 Claims, 6 Drawing Sheets

SECTION A-A

FLASHLIGHT DEPLOYMENT SYSTEM

CROSS-REFERENCE TO RELATED APPLICATIONS

This application claims priority of provisional application 60/981,201.

STATEMENTS REGARDING FEDERALLY SPONSORED RESEARCH AND DEVELOPMENT

Not applicable.

BACKGROUND

The embodiments of the present invention satisfy the needs of providing a way of holding a wide variety of tactical and utility flashlights securely and placing them in ideal custom ready-to-draw positions, of providing an improved holder for a flashlight, and of providing a variably positionable sheath for a flashlight.

Information relevant to attempts to address these problems can be found in U.S. Pat. No. 6,817,499, and patent application 60/987745, both by the present inventor; which are not admitted to be prior art with respect to the present invention by its mention in this Background Section. U.S. Pat. No. '499 has a locking tongue in a chamber adjacent to the cavity and not in the cavity, and it has no unshaped flexible grasping member. Patent application '7745 has a c-shaped flexible grasping member and not a unshaped flexible grasping member, and it has no locking tongue. Moreover the peg and o-ring configurations differ between the inventions. In '7745 and '499 the o-rings attach the locator disk to the leverage back. In the present application the o-rings attach the locator disk to the sheath or the locator disk base.

SUMMARY

The embodiments of the present invention are directed to an apparatus that satisfies the needs set out in the Background section.

The embodiments of the present invention comprise a holder for a flashlight, comprising a sheath formed with a cavity, wherein the cavity comprises at least one unshaped flexible grasping member, said sheath having a proximal end and a distal end, said sheath formed in a cross shape having a horizontal member terminating at both of its ends in a lateral member, said lateral members each terminating in two hinge knuckles having axial bores; a means for variably positioning the sheath during use; and a means for securing the sheath to a user. They further comprise a variably positionable sheath for a flashlight comprising a sheath, wherein the sheath is formed with an interior and exterior, having at least one unshaped flexible grasping member in the sheath interior and an axial post on the sheath exterior, said sheath having a proximal end and a distal end, said sheath formed in a cross shape having a horizontal member terminating at both of its ends in a lateral member, said lateral members each terminating in two hinge knuckles having axial bores; a rotatable disk mountable on an axial post on a disk base on the sheath; at least one o-ring demountably positionable on each disk peg and on a disk base peg; and a means for detachably securing said sheath to a user. They further comprise a method for manufacturing a sheath for a flashlight comprising providing a sheath; including at least one unshaped flexible grasping member and an axial post, said sheath having a proximal end and a distal end, said sheath formed in a cross shape having a horizontal member terminating at both of its ends in a lateral member, said lateral members each terminating in two hinge knuckles having axial bores; configuring a disk for rotatable mounting on the axial post; disposing on the sheath a means for returning the sheath to a zero position; and furnishing means for securing the sheath on a user.

Briefly, the present invention provides an apparatus and a method for manufacturing a variably positionable sheath for a flashlight that includes a sheath having a cavity. At least one u-shaped flexible removable grasping member is formed in the cavity. The u-shaped member has bent arms that apply pressure to the flashlight bell when it is inserted into the cavity. Also provided are means for variably positioning the sheath during use by a user. The variably positioning means includes a disk. A disk with a plurality of pegs is rotatably mounted on an axial post on a disk base on the sheath, with o-rings demountably positionable around pegs on the disk and around pegs on a disk base, allowing the sheath to be rotated by the user and causing it to return automatically to its original position. The present invention also includes means for securing the sheath to a user during use of the invention. The securing means includes a clamp, band, or lap-over band, one end of which is engagable with the block, the other end of which maybe attached to the user of the present invention by inserting the lap-over band over, for example, a belt. The present invention, therefore, is particularly, but not exclusively, useful for allowing the sheath to return to a zero position after a flashlight has been removed from or reinserted in the sheath.

The advantages of the embodiments of the invention include but are not limited to the feature that, upon removing the flashlight from the sheath, when grasping the handle of the sheathed flashlight no matter how aggressively, the locator disk rotates in a clock-wise or counter clock-wise direction around its collar, and the o-rings are distended in one or more directions. When the sheathed object is removed from the sheath, because the o-rings are elastic the sheath rotates back to the original start position ready for reinsertion of the flashlight into the sheath. The o-rings allow for up to 32 degrees rotation parallel to the direction of the flashlight pull. Approximately 75% of the draws require only 18 degrees rotation. Approximately 12% of the draws require 24 degrees rotation. Only a few skilled draws require the full 32 degrees rotation. Moreover, the resting sheath angle is adjustable to the desired draw position, and can be rotated to any of eight different locator positions by simply adjusting the locator disk; the number or weight of o-rings may be changed to customize the tension of the draw or to suit the weight of the flashlight; and different sizes of bell membranes are available to accommodate different sizes of flashlights. Using the embodiments of the present invention, a drawing action becomes a single action that takes less than a second. They allow for multiple carry placements and draw positions per the preference and need of the user, such as left or right, on the belt, front or back, high (on a shoulder holster, webbing, suspenders or tactical vest or pack) or low (on a thigh pocket or boot).

DRAWINGS

These and other features, aspects and advantages of the embodiments of the device and/or methods will become better understood with reference to the following description, appended claim and accompanying drawings where:

REFERENCE NUMERALS FOR DRAWINGS

Figure 1:
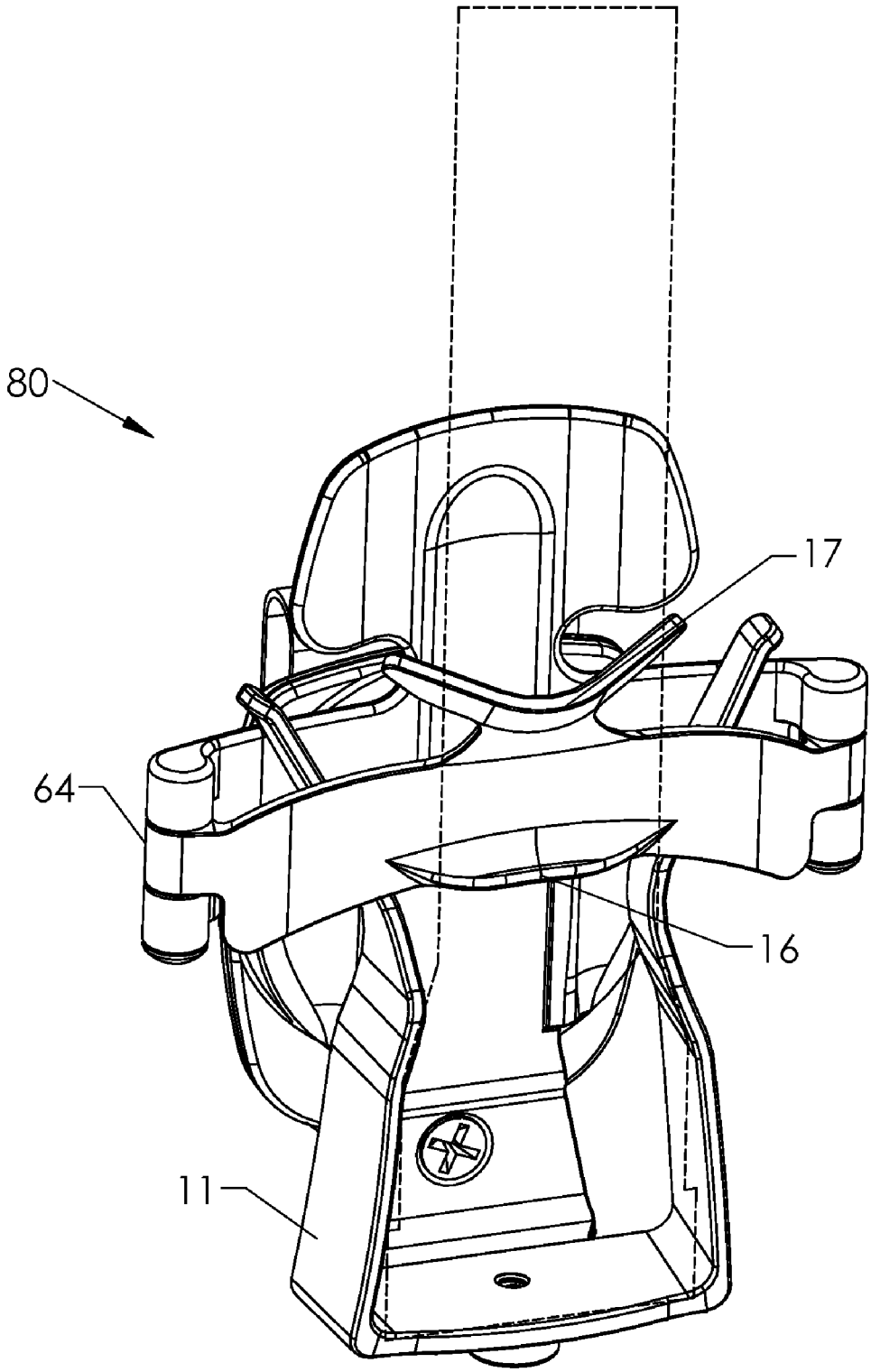
FIG. 1 shows a perspective view of the variably positionable sheath for a flashlight in an operative manner.

11 bell membrane;
15 front horizontal membrane;
16 fin;
17 bell cradle;
20 locator disk base;
21 recess;
22 axial post;
23 locator disk base hole;
24 monolithically extending base pegs;
25 o-ring;
30 locator disk;
31 monolithically extending posterior pegs;
32 collar;
33 locator disk center hole;
35 cone-head set screws;
36 monolithically extending anterior pegs;
34 groove
40 belt clip;
41 leverage back peripheral hole;
42 leverage back center hole;
45 king screw;
50 Sam Brown screw;
55 leverage back;
60 back horizontal membrane;
63 foot;
64 hinge knuckle;
65 hinge screw;
66 foot hole;
70 bell membrane screw;
75 horizontal membrane screw;
76 back horizontal membrane hole;
77 cavity; and
80 sheath.

DESCRIPTION

Definitions

As used in this document, elastic means that the o-ring 25 is manufactured of synthetic rubber or similar material, is capable of recovering size and shape after deformation, is also capable of recovering quickly after expansion or retraction, is easily stretched or expanded, resumes it original or former shape, resists deformation by stretching, and may be bent twisted or folded without any perceptible sign of injury.

Zero position means the position the thing was originally at before it was displaced to a second position.

Description of the Preferred Embodiment

In overview, the embodiments of the present invention consist of: a sheath means 80; a means for variably positioning the sheath 80; and a means for securing the sheath 80 to a user. The sheath means comprise at least one u-shaped flexible removable grasping member or bell membrane 11 that is formed in a cavity 77 in the sheath 80. In the preferred embodiment, the grasping members comprises arms of the u-shaped member 11 that bend inwardly medially to apply pressure to the flashlight bell when it is inserted into the cavity 77. Also provided are means for variably positioning the sheath 80 during use by a user. The variably positioning means includes a disk 30 with a plurality of posterior pegs 31 and anterior pegs 36 which disk 30 is rotatably mounted on the sheath 80. At least one o-ring 25 is demountably positionable both around a posterior peg 31 on the disk 30 and around a base peg 24 on the locator disk base 20, allowing the sheath 80 to be rotated by the user and causing it to return automatically to its original position. The embodiments of the present invention also include means for securing the sheath 80 to a user during use of the invention. The securing means includes a clamp, band, or lap-over band 40, one end of which is engagable with a leverage back 55, the other end of which maybe attached to the user of the present invention by inserting the lap-over band 40 over, for example, a belt. The embodiments of the present invention, therefore, are particularly but not exclusively useful for allowing the sheath to return to a zero position after a flashlight has been removed from or reinserted in the sheath 80.

Means for Variably Positioning the Sheath

Figure 2:
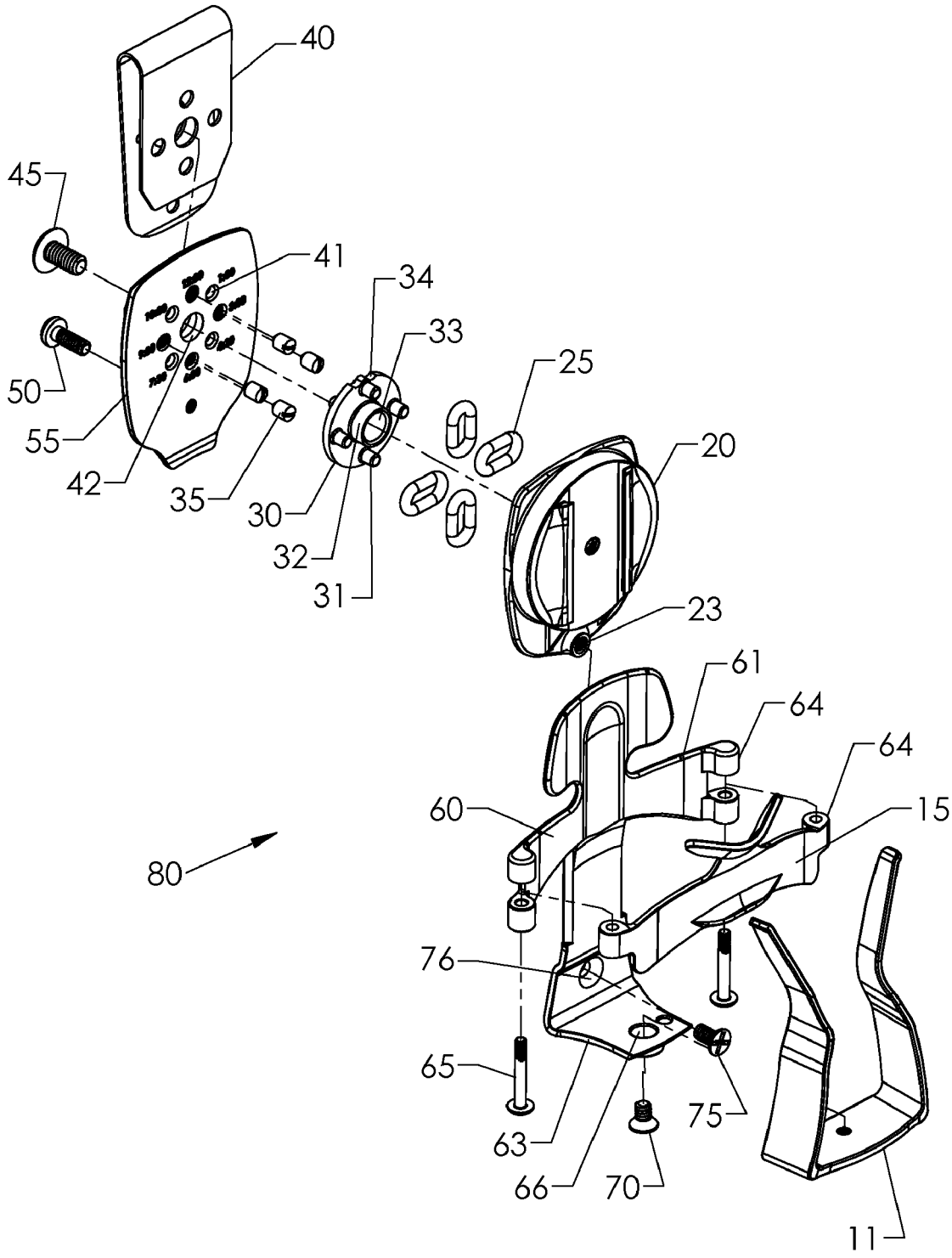
FIG. 2 shows a perspective unassembled view of the sheath comprising front, back and bell membranes; the locator disk and locator disk base; the leverage back; the belt clip; and screws and o-rings.
Figure 3:
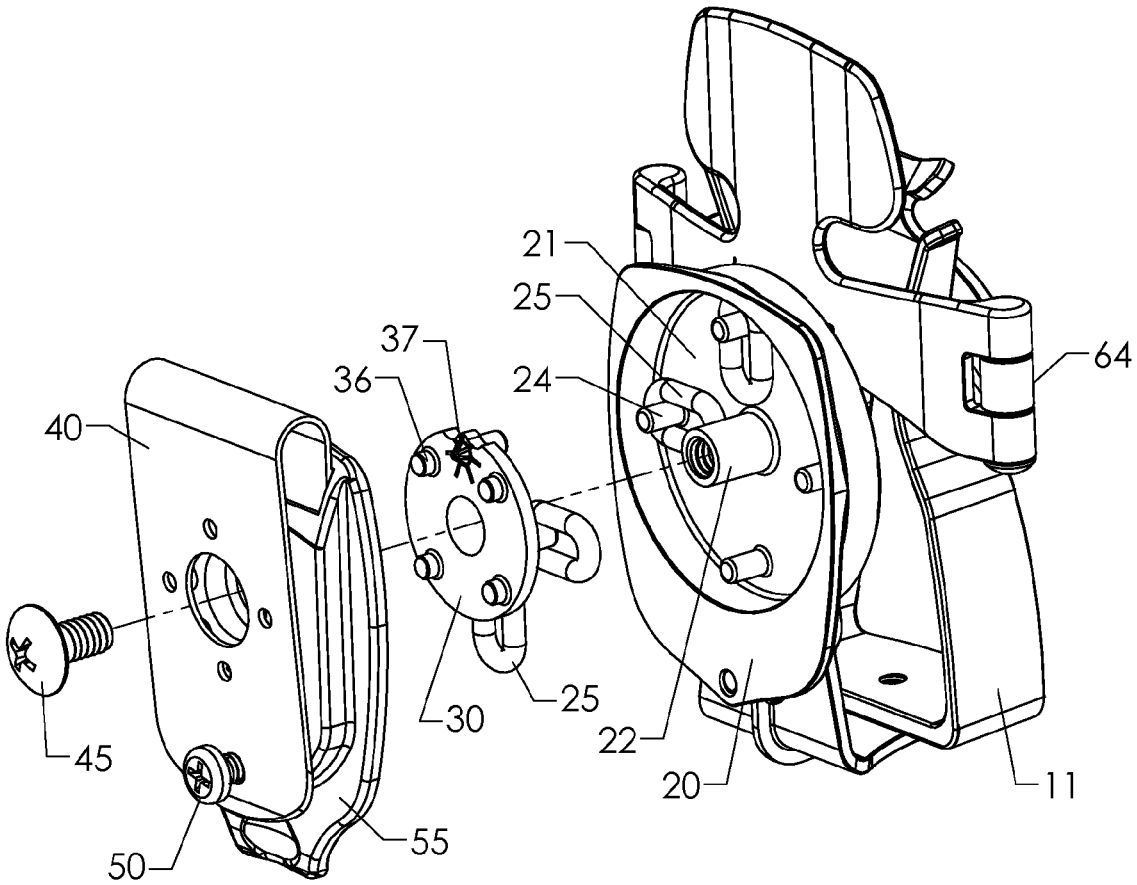
FIG. 3 shows an exploded perspective view of the sheath comprising front, back and bell membranes; the locator disk and locator disk base; the leverage back; the belt clip; and screws and o-rings.

As shown in FIGS. 1, 2 and 3, the embodiments of the invention include a means for variably positioning the sheath 80, comprising a locator disk 30 with monolithically extending posterior pegs 31 and monolithically extending anterior pegs 36, a collar 32, means for fastening 45, o-rings 25, a locator disk base 20 with recess 21 and axial post 22 and monolithically extending base pegs 24, and a leverage back 55.

Leverage Back

As shown in FIG. 2, the leverage back 55 is formed with an anterior side, a posterior side, a top and bottom, a leverage back center hole 42, and a plurality of leverage back peripheral holes 41. In the preferred embodiment there are eight leverage back peripheral holes 41 symmetrically arranged around the leverage back center hole 42 (hence "center" hole), and the leverage back center hole 42 is laterally positioned in the top of the leverage back 55.

The leverage back 55 is fixedly mounted to the clip 40 by a fastening means selected from the group consisting of screws, nails, rivets, staples, nuts and bolts, which fastening means extend through the leverage back into the clip 40. In the preferred embodiment the fastening means is a plurality of "cone-head set screws" 35.

Locator Disk

As shown in FIGS. 2 and 3, the locator disk 30 is formed with an anterior side, a posterior side, and a wall extending between the anterior side and the posterior side.

The locator disk 30 further comprises a plurality of posterior pegs 31 extending at substantially right angles from posterior side of the locator disk 30, and a plurality of anterior pegs 36 extending at substantially right angles from the anterior side of the locator disk 30. Each anterior peg 36 fits into a leverage back peripheral hole 41. In the preferred embodiment, the plurality of posterior pegs 31 and anterior pegs 36 extend monolithically from the locator disk 30.

The locator disk 30 further comprises a locator disk center hole 33 that is formed through the locator disk 30 substantially in the middle of the locator disk 30 and extending between the anterior side and the posterior side of the locator disk 30.

The locator disk 30 further comprises a collar 32 that monolithically extends from the posterior of the locator disk 30 as a shallow tube from the circumference of the locator disk center hole 33. The collar 32 is formed with an exterior side, an interior side, and a wall extending between the exterior side and the interior side. The collar 32 is provided for rotatable engagement with an axial post 22 extending from the recess 21 that is in the anterior side of the locator disk base 20.

The locator disk 30 further comprises two adjacent grooves 34 in the wall that extends between the anterior side and the posterior side. The grooves 34 may be semi-circular. The purpose of the grooves 34 is to enable or facilitate tactile recognition for disk rotational orientation.

The locator disk 30 is rotatably mountable on the anterior side of the locator disk base 20 by the elastic action of a plurality of elastic o-rings 25, which o-rings 25 demountably positionably engage the posterior pegs 31 of the locator disk 30 and the base pegs 24 of the locator disk base 20. The o-rings 25 bring the locator disk 30 back to its original resting position after it is rotated on the collar 32.

Locator Disk Base

As shown in FIGS. 2 and 3, the locator disk base 20 is formed with an anterior side, a posterior side, a wall extending between the anterior side and the posterior side, a top and a bottom.

The locator disk base 20 further comprises a recess 21. The recess 21 accommodates the collar 32 of the locator disk 30. An axial post 22 in the recess 21 for receiving the king screw 45 extends monolithically and perpendicularly along the center axis of the locator disk base 20 towards the locator disk 30. One or more base pegs 24 extend at substantially right angles from the recess 21.

The locator disk base 20 functions in part as a platform to which the locator disk 30 is fastened with a plurality of elastic o-rings 25 that are each demountably positionable around one of the posterior pegs 31 that extend from the locator disk 30 and around one or more base pegs 24 that extend from the locator disk base 20.

The locator disk base 20 is connected to the back horizontal membrane 60 by a fastening means 75 selected from the group consisting of screws, nails, rivets, staples, nuts and bolts, preferably by a screw. In the preferred embodiment, the fastening means 75 is screwed into the posterior side of a back horizontal membrane hole 76 in the bottom of the back horizontal membrane 60 and then into the posterior side of a locator disk base hole 23 in the bottom of the locator disk base 20.

Means for Securing Sheath to User

The means for securing the sheath 80 to the user comprises a belt clip 40.

Belt Clip

As shown in FIGS. 2 and 3, the lap-over bad or belt clip 40 is fixedly attached to the leverage back 55 by a fastening means selected from the group consisting of screws, nails, rivets, staples, nuts and bolts, and in the preferred embodiment by a plurality of "Sam Brown" screws 50 and by the king screw 45.

Sheath Means

As shown in FIG. 2, the sheath 80 comprises a back horizontal membrane 60, a front horizontal membrane 15, a bell membrane 11, and means for fastening.

Back Horizontal Membrane

As shown in FIG. 2, the back horizontal membrane 60 comprises an anterior side, a posterior side, a wall connecting the anterior side and the posterior side, a top and a bottom. It further comprises approximately a cross shape formed by two lateral members 61 and a horizontal member 62, additionally comprising a foot 63 extending perpendicularly to the posterior from its bottom.

The two lateral members 61 of the back horizontal membrane 60 each terminate in two hinge knuckles 64 having axial bores. The foot 63 has a foot hole 66 in the bottom for receiving a fastening means 70.

Front Horizontal Membrane

As shown in FIG. 2, the front horizontal membrane 15 comprises approximately an elongated rectangle, having an anterior side, a posterior side, a wall connecting the anterior side and the posterior side, a top and a bottom.

The terminal ends of the front horizontal membrane 15 each terminate in a hinge knuckle 64 having an axial bore.

To hingedly attach the back horizontal membrane 60 with the front horizontal membrane 15, the knuckle 64 of the front horizontal membrane 15 is received between the two knuckles 64 of the back horizontal membrane so that the axial bores of each of the knuckles 64 are disposed in longitudinal, axial alignment for receipt of the fastening means 65 therethrough. The fastening means 65 includes an enlarged head to stop the fastenings means 65 once fully inserted, to thereby prevent the fastenings means 65 from passing through the knuckles.

The front horizontal membrane 15 further comprises a fin 16 on its posterior and a cradle 17 on its top. As shown in FIGS. 1, 4, 5A and 5B, the cradle 17 is slanted towards the posterior to facilitate accepting the bell of the flashlight.

Bell Membrane

Figure 4:
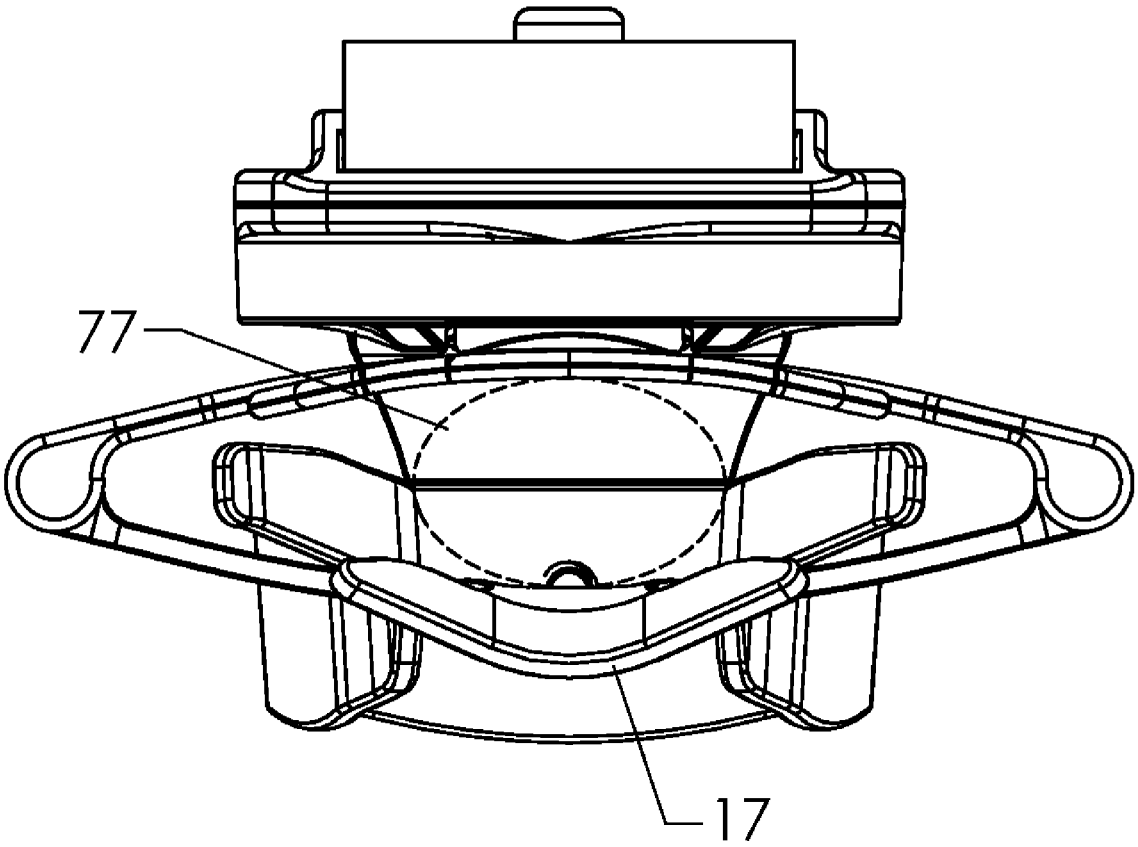
FIG. 4 shows an end view of the sheath.
Figure 5A:
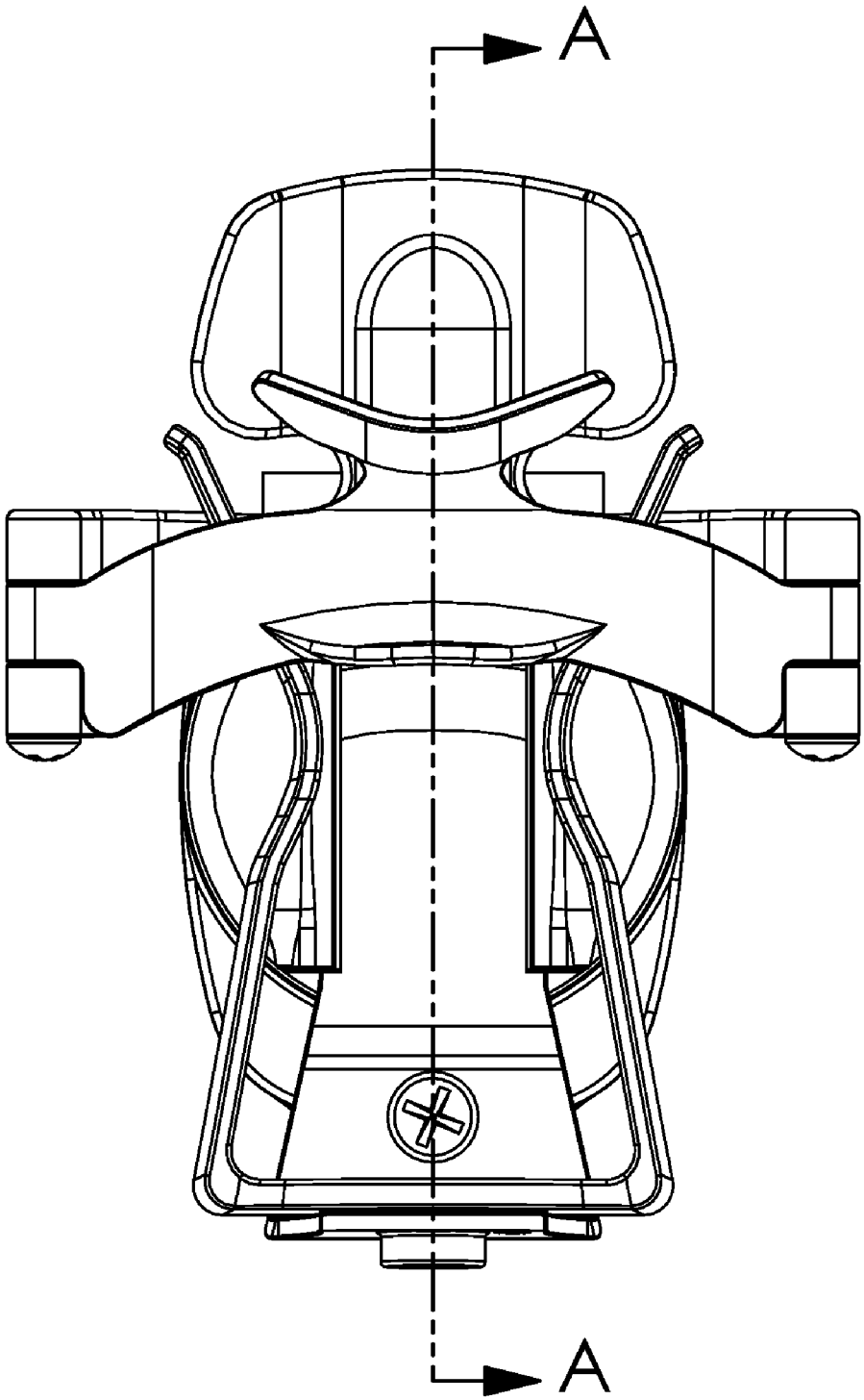
FIG. 5A and FIG. 5B show front and side views of the sheath, respectively.
Figure 5B:
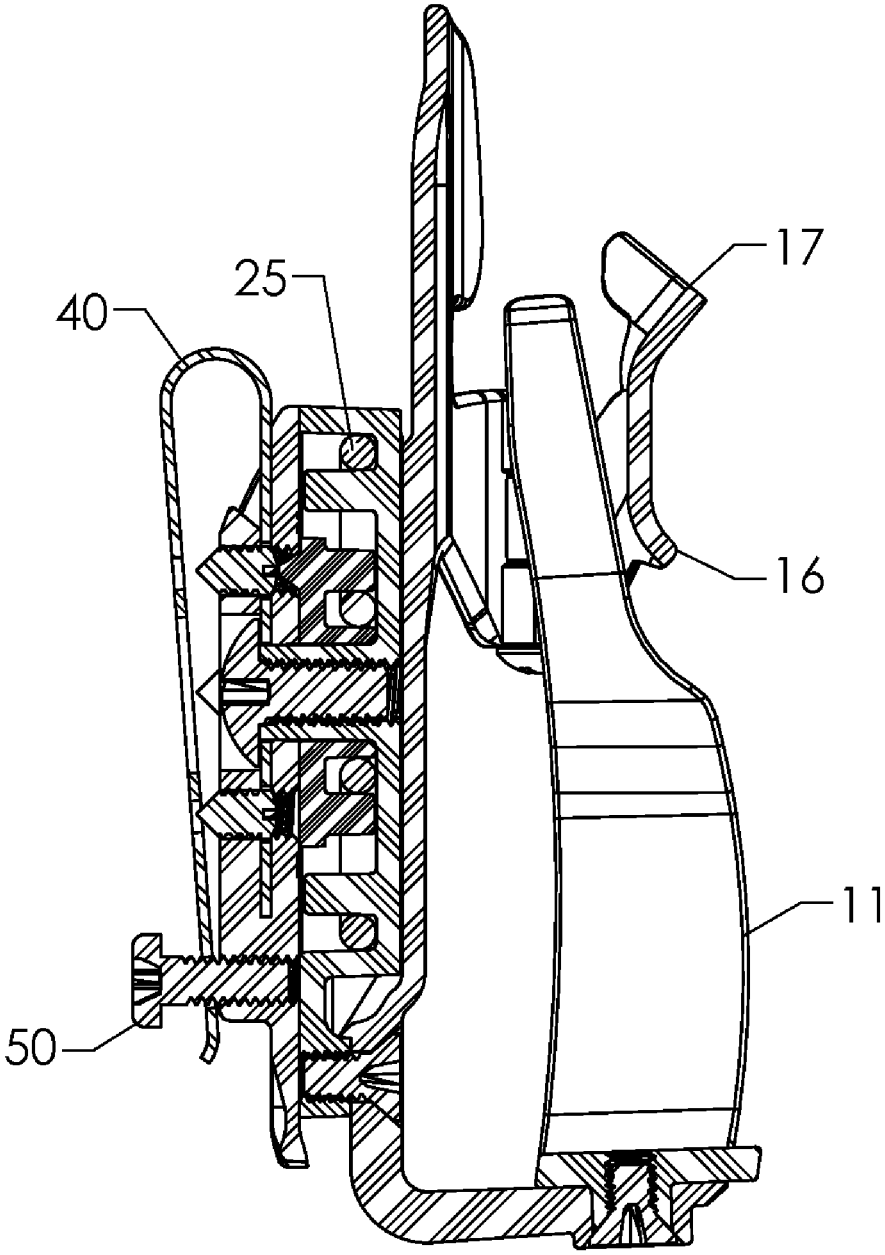

As shown in FIGS. 1 and 5B, the bell membrane 11 comprises a generally u-shaped flexible grasping member, having a top and a bottom. It comes in a variety of sizes for accommodating flashlight belts in a variety of sizes. As shown in FIG. 4, in the preferred embodiment the two vertical arms of the u-shape are formed to bend inward medially and outward distally, which bends apply pressure to the flashlight bell when it is inserted into the cavity 77 of the sheath 80.

As shown in FIG. 2, the bell membrane 11 is connected to the back horizontal membrane 60 by a means selected from the group consisting of screws, nails, rivets, staples, nuts and bolts, preferably by a threaded screw 70. The screw enters from the bottom through a hole in the bottom of the bell membrane 11 and then a hole in the foot of the back horizontal membrane 60.

The combination of the membranes form a cavity 77 that accepts the flashlight bell.

In a preferred embodiment, the membranes 11 15 60, the locator disk 30 and locator disk base 20, and leverage back 55 are manufactured preferably of a material such as an acrylic/PCB thermoplastic with high impact and abrasion resistant qualities. Preferably, the materials used would be impervious to most chemicals, solvents, petroleum-based products, and moisture, including salt water. The material, when heated and manipulated, should retain its shape without shrinking or cracking, even under repeated stress. Preferably, such a material would be a synthetic resinous compound in the form of powder or pellets for use in the manufacture of molded parts. In addition, preferably the material would be fire retardant. The material should no decay, rot, dry out or absorb moisture. Despite repeated use, material used in manufacturing the present invention should hold its shape so as to allow safe one-handed removal of a flashlight from sheath 80, as well as reholstering flashlight. In a preferred embodiment, the aforementioned parts are manufactured of KYDEX or CONCEALEX, both products of the KLEERDEX company.

Method for Manufacturing the Embodiments of the Invention

The method for manufacturing the embodiments of the invention comprise: providing a sheath with a cavity and having an axial post; providing at least one u-shaped flexible removable grasping member in the cavity; configuring a disk for rotatable mounting on the sheath; and disposing on the sheath means for returning the sheath to a zero position.

Some Advantages of the Embodiments of the Invention

As previously mentioned, the embodiments of the present invention are designed to hold a wide variety of tactical and utility flashlights securely and place them in ideal custom ready-to-draw positions. Using the embodiments of the present invention, a drawing action becomes a single action that takes less than a second. They allow for multiple carry placements and draw positions per the preference and need of the user, such as left or right, on the belt, front or back, high (on a shoulder holster, webbing, suspenders or tactical vest or pack) or low (on a thigh pocket or boot). They can be rotated to any of eight different locator positions by simply adjusting the locator disk 30.

Method for Using the Embodiments of the Invention

To adjust the resting sheath 80 angle to the desired draw position, the king screw 45 is removed, and the leverage back 55 is separated from the locator disk 30. The anterior pegs 36 on the locator disk 30 are then placed into the leverage back peripheral holes 41 in the leverage back 55 that correspond to the desired sheath 80 angle. The leverage back 55 and the king screw 45 are then replaced.

Using a similar procedure, the number or weight of o-rings 25 may be changed to customize the tension of the draw or to suit the weight of the flashlight. The king screw 45 is removed, and the locator disk 30 is separated from the locator disk base 20. The o-rings are strung around or removed from one of the posterior pegs 31 and the base pegs 24.

Different sizes of bell membranes 11 are available to accommodate different sizes of flashlights. The bell membrane 11 may be removed or installed by removing or installing the bell membrane screw 70.

To use the embodiments of the invention, a flashlight is inserted by securely gripping with the hand, and then laying the bell of the flashlight into the bell cradle 17. The handle of the flashlight is then simultaneously pushed down into the backstop and rotated inwardly. Upon removing the sheathed flashlight, when grasping the handle of the sheathed flashlight no matter how aggressively, the locator disk 30 rotates in a clock-wise or counter clock-wise direction around its collar 32, and the o-rings 25 are distended in one or more directions. When the sheathed object is removed from the sheath 80, because the o-rings 25 are elastic the sheath 80 rotates back to the original start position ready for reinsertion of the flashlight into the sheath 80. The o-rings 25 allow for up to 32 degrees rotation parallel to the direction of the flashlight pull. Approximately 75% of the draws require only 18 degrees rotation. Approximately 12% of the draws require 24 degrees rotation. Only a few skilled draws require the full 32 degrees rotation.

Some advantages of the embodiments of the apparatus were previously enumerated in the Summary section. Every advantageous feature does not need to be incorporated into every embodiment of the apparatus and/or methods.

Although these versions of the invention have been described in considerable detail, other versions are possible. For example, the bell membrane may utilize features other than inwardly bent arms to grip the flashlight. Therefore, the spirit and scope of the appended claims should not be limited to the description of the versions contained therein.

I claim:

1. A holder for a handle of a hand tool, comprising:

A. a sheath formed with a cavity, said cavity including at least one u-shaped flexible grasping member, said sheath having a proximal end and a distal end, said sheath formed in a cross shape having a horizontal member terminating at both of its ends in a lateral member, said lateral members each terminating in two hinge knuckles having axial bores, wherein said u-shaped flexible grasping member is connected to said sheath by a fastening means selected from the group consisting of screws, nails, rivets, staples, nuts and bolts;

B. a rotatable disk formed with an anterior side, a posterior side, a center, a wall extending between the anterior side and the posterior side, said disk comprising a plurality of posterior pegs extending at right angles from said posterior side of said disk, and a plurality of anterior pegs extending at right angles from said anterior side of said disk; and C. a means for securing the sheath to a user.

2. The holder of claim 1, wherein said fastening means enters from said bottom of said u-shaped member.

3. A holder for a handle of a hand tool, comprising:

A. a sheath formed with a cavity, said cavity including at least one u-shaped flexible grasping member, said sheath having a proximal end and a distal end, said sheath formed in a cross shape having a horizontal member terminating at both of its ends in a lateral member, said lateral members each terminating in two hinge knuckles having axial bores, wherein said u-shaped flexible grasping member is removably insertable into said cavity;

B. a rotatable disk formed with an anterior side, a posterior side, a center, a wall extending between the anterior side and the posterior side, said disk comprising a plurality of posterior pegs extending at right angles from said posterior side of said disk, and a plurality of anterior pegs extending at right angles from said anterior side of said disk; and C. a means for securing the sheath to a user.

4. A holder for a handle of a hand tool, comprising:

A. a sheath formed with a cavity, said cavity including at least one u-shaped flexible grasping member, said sheath having a proximal end and a distal end, said sheath formed in a cross shape having a horizontal member terminating at both of its ends in a lateral member, said lateral members each terminating in two hinge knuckles having axial bores;

B. a rotatable disk formed with an anterior side, a posterior side, a center, a wall extending between the anterior side and the posterior side, said disk comprising a plurality of posterior pegs extending at right angles from said posterior side of said disk, and a plurality of anterior pegs extending at right angles from said anterior side of said disk;

C. a means for securing the sheath to a user; and

D. a locking tongue, said locking tongue having an anterior side, a posterior side, a wall connected said anterior side and said posterior side, a longitudinal axis, and a proximal end and a distal end, wherein said locking tongue is hingedly attached to said hinge knuckles on said sheath, wherein said locking tongue further comprises a cradle on its proximal end.

5. A holder for a handle of a hand tool, comprising:

A. a sheath formed with a cavity, said cavity including at least one u-shaped flexible grasping member, said sheath having a proximal end and a distal end, said sheath formed in a cross shape having a horizontal member terminating at both of its ends in a lateral member, said lateral members each terminating in two hinge knuckles having axial bores;

B. a rotatable disk formed with an anterior side, a posterior side, a center, a wall extending between the anterior side and the posterior side, said disk comprising a plurality of posterior pegs extending at right angles from said posterior side of said disk, and a plurality of anterior pegs extending at right angles from said anterior side of said disk;

C. a means for securing the sheath to a user; and

D. a locking tongue, said locking tongue having an anterior side, a posterior side, a wall connected said anterior side and said posterior side, a longitudinal axis, and a proximal end and a distal end, wherein said locking tongue is hingedly attached to said hinge knuckles on said sheath, wherein an arch is formed in said locking tongue between its top and its bottom along said longitudinal axis to form a dome segment on its anterior side.

* * * * *